United States Patent [19]

Heim

[11] 4,143,750

[45] Mar. 13, 1979

[54] SERRATION DETECTOR

[75] Inventor: Edward L. Heim, Florissant, Mo.

[73] Assignee: Coin Acceptors, Inc., St. Louis, Mo.

[21] Appl. No.: 848,586

[22] Filed: Nov. 4, 1977

[51] Int. Cl.[2] ..... G07F 3/02; G07F 3/04

[52] U.S. Cl. ..... 194/97 R

[58] Field of Search ..... 194/97 R, 97 A, 99, 194/102; 133/3 R

[56] References Cited

U.S. PATENT DOCUMENTS

| | | | |
|---|---|---|---|
| 3,483,958 | 12/1969 | Pennell et al. | 194/102 |
| 3,497,049 | 2/1970 | Erickson | 194/97 R |
| 3,592,307 | 7/1971 | Hammond | 194/97 R |

FOREIGN PATENT DOCUMENTS

| | | | |
|---|---|---|---|
| 695726 | 12/1930 | France | 194/97 |

*Primary Examiner*—Joseph J. Rolla

*Attorney, Agent, or Firm*—Cohn, Powell & Hind

[57] ABSTRACT

The selector assembly includes a support plate and a rail that directs a coin into a coin serration detector assembly. The serration detector assembly includes a body pivotally mounted to the support plate, and a wire feeler attached to the body and providing a wire portion disposed with its side transverse to and engageable with the edge of a coin moving in a predetermined trajectory from the rail. The wire portion side engages the serrations of a serrated coin to rotate the wire feeler into the path of the serrated coin to change the trajectory and direct the serrated coin in one direction, and engages a substantially nonserrated coin to rotate the wire feeler away from the trajectory and permit movement of the nonserrated coin in another direction.

7 Claims, 8 Drawing Figures

FIG. 7
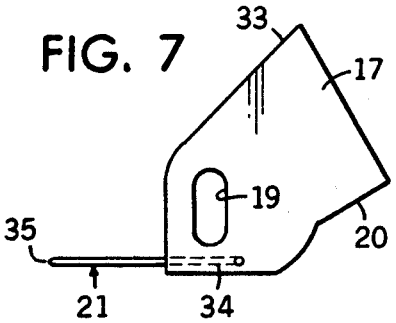
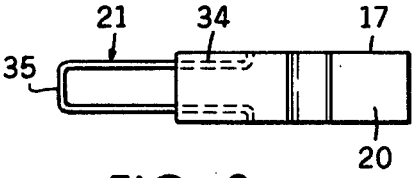
FIG. 8
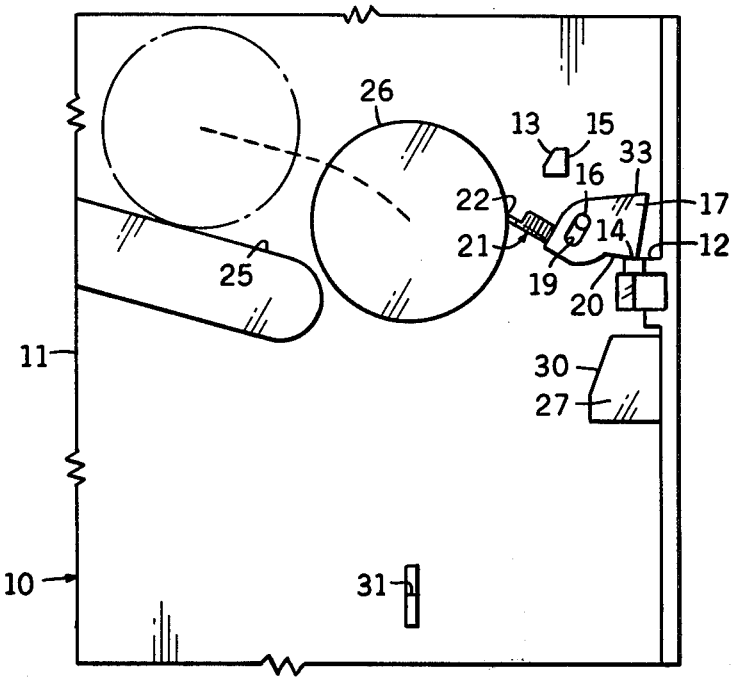
FIG. 1
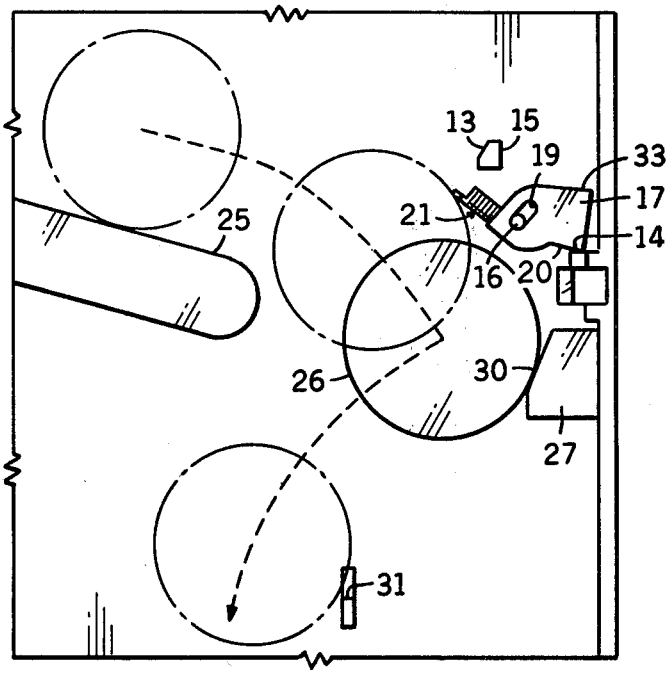
FIG. 2

FIG. 5
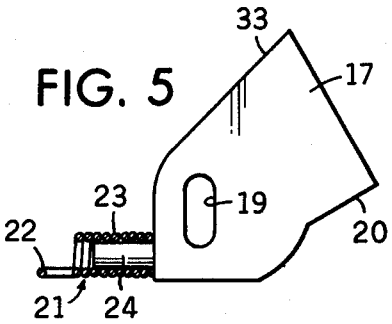
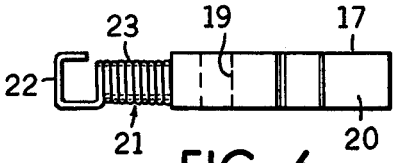
FIG. 6
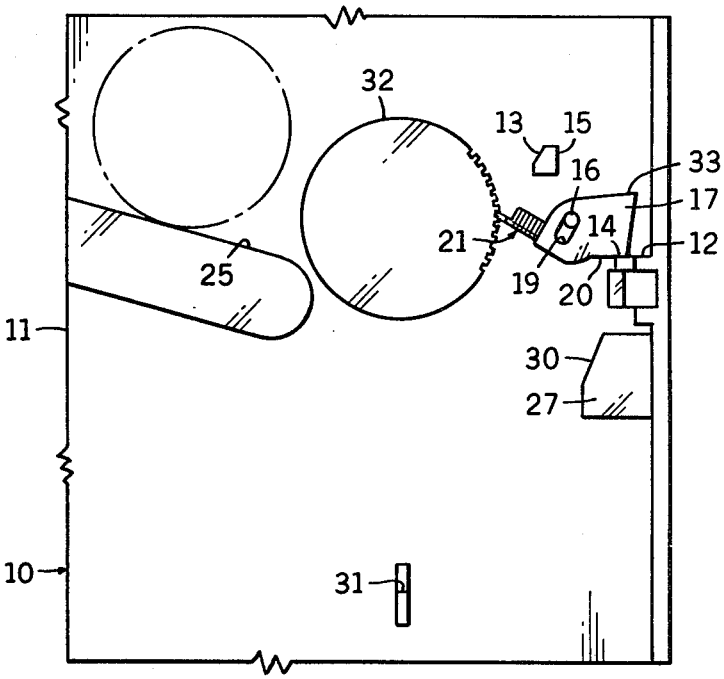
FIG. 3
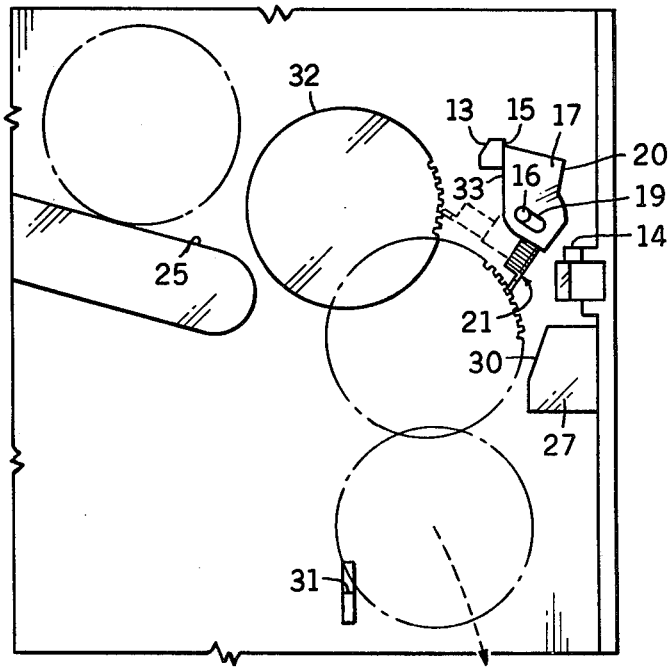
FIG. 4

SERRATION DETECTOR

BACKGROUND OF THE INVENTION

This invention relates generally to coin selecting and separating devices, and in particular to a selection device for detecting edge surface characteristics such as serrations.

In the known prior art, the separation of serrated and smooth-edged coins has been effectuated by modifying the well-known coin cradle as is disclosed for example in U.S. Pat. No. 3,120,300. Coin cradles, which are basic to coin selecting devices of the type under discussion, are useful for separating coins on a basis of size and weight. Selected coins are then directed into a predetermined path for further tests, such as the magnetic test for metal differentiation. Modification of the coin cradle so that it will perform the additional functions of accepting or rejecting coins on the basis of whether or not they have serrated edges obviously presents certain problems. Such a modified cradle, for example, is not easily susceptible to fine adjustment with regard to its new function of detecting coin serration, except at the risk of affecting the balance of the cradle. This balance, of course, is necessary if the cradle is to perform its original functions of size and weight separation adequately.

Serration detectors of this general type are disclosed in U.S. Pat. Nos. 3,592,307 and 3,598,217, owned by the same assignee. In these serration detectors, the feeler is comprised of a thin spring steel blade insert molded into a zinc base die cast or plastic body. This spring steel blade is then trimmed to length after molding. Because of variation in blade material and production trim equipment, the condition of the detector blade surface operating on the coin edge is of variable and inconsistent quality. This variable produces erratic and unpredictable operation of the serration detector in the final acceptor assembly, such that smooth edge slugs may be accepted as genuine coinage and/or genuine coinage may be rejected as slugs.

SUMMARY OF THE INVENTION

The present device is independent of the basic cradle and provides a separate stage in a coin-selecting mechanism for performing the function of separating serrated and nonserrated coins. Because of its independence, the serration selector is susceptible to balancing adjustment which is not available in the modified cradle selection detector.

This serration detector utilizes a wire as the feeler and is disposed so that the side of the wire engages the coin edge. The wire radius can be relied upon to be consistent from part to part, and thereby effectively eliminates the above discussed disadvantages of using a trimmed end on a spring steel blade.

The selector assembly is located down path of a rail on a support which directs a coin in a predetermined trajectory. The serration detector in the selector assembly includes a body pivotally mounted to the support, and a wire feeler attached to the body and providing a wire portion disposed with its side transverse to and engaging the edge of a coin moving in the predetermined trajectory. The wire portion side engages the serrations of a serrated coin to rotate the wire feeler into the path of the serrated coin to change the trajectory and direct the serrated coin in one direction, and engages a substantially nonserrated coin to rotate the wire feeler away from the trajectory and permit movement of the nonserrated coin in another direction.

The wire portion engageable transversely with the coin edge has a predetermined cross-sectional dimension to provide reliable reaction with the serrated and nonserrated coin edges. More particularly, the wire portion has a predetermined radius.

The wire feeler resiliently mounts the wire portion engageable with the coin edge, and flexes to reduce stress from coin impact.

In one embodiment, the wire feeler is substantially U-shaped having its ends attached to the pivotally mounted body and having its bight providing the transverse wire portion engageable with the coin edge, the wire feeler being of a predetermined cross-sectional dimension to provide reliable reaction of the transverse wire portion with the serrated and nonserrated coin edges.

In another embodiment, the wire feeler is a coil spring having one end attached to the body and having the other end providing the transverse wire portion engageable with the coin edge, the wire feeler being of a predetermined cross-sectional dimension to provide reliable reaction of the transverse wire portion with the serrated and nonserrated coin edges.

The coil spring extends from and positions the wire portion engageable transversely with the coin edge outwardly from the pivotally mounted body, the coil spring being resiliently flexible to reduce stress from coin impact and yet assume a predetermined initial position.

BRIEF DESCRIPTION OF THE DRAWINGS

FIG. 1 is a fragmentary elevational view of the selector assembly illustrating the disposition of parts immediately upon feeler engagement with a nonserrated coin;

FIG. 2 is a fragmentary elevational view of the selector assembly illustrating the disposition of parts immediately following feeler engagement with a nonserrated coin;

FIG. 3 is a fragmentary elevational view of the selector assembly illustrating the disposition of parts immediately upon feeler engagement with a serrated coin;

FIG. 4 is a fragmentary elevational view of the selector assembly illustrating the disposition of parts immediately following feeler engagement with a serrated coin;

FIG. 5 is an enlarged side elevational view, partly in cross section, of the serration detector used in the assembly of FIGS. 1–4;

FIG. 6 is a bottom plan view of the serration detector shown in FIG. 5;

FIG. 7 is an enlarged side elevational view of a modified serration detector, and FIG. 8 is a bottom plan view of the serration detector shown in FIG. 7.

DESCRIPTION OF THE PREFERRED EMBODIMENTS

Reffering first to FIGS. 1–4, it will be understood that the complete coin acceptor device 10 is not shown. Only such details of the complete device 10 are shown as are believed necessary to the explanation and description of those parts of the device which are pertinent to an understanding of the selector assembly for detection of serrated and nonserrated coins. Prior stages of the coin acceptor mechanism in which the coin is deposited into a suitable slot and directed into a cradle mechanism are omitted for clarity. Likewise, such mechanism as is used for separating coins with regard to their metallic content are omitted. FIG. 1 shows the disposition of selector parts immediately upon engagement with a coin, and in particular shows the engagement with a nonserrated coin. FIG. 2 shows the disposition of selector parts after such engagement with a nonserrated coin. FIGS. 3 and 4 illustrate the dispositions of the various parts of the coin selector assembly when subjected to the action of a serrated coin.

Referring now by characters of reference to the drawings, and first to FIG. 1, it will be understood that the coin selector device 10 includes a support plate 11 constituting a support means. Formed on the support plate 11 are a pair of projecting stop means 12 and 13 providing first and second abutments 14 and 15 respectively. A pin 16, constituting a pivot means, is attached to and projects outwardly from the support plate 11.

The serration detector includes a body 17 having a slot 19 that receives the pivot pin 16. A shoulder 20 on the body 17 seats on the abutment 14 in the inoperative position of the serration detector. Thus, the pin 16 and the abutment 14 constitutes a mounting means, mounting the serration detector to the support plate 11. The center of gravity of the serration detector lies between the abutment 14 and the slot 19. This arrangement assures that the serration detector is at rest when inoperative.

The serration detector also includes a wire feeler 21 attached to the body 17 and providing a transverse portion 22, as is best shown in FIGS. 5 and 6, disposed with its side transverse to and engaging the edge of a coin moving in a predetermined trajectory as will be later explained. In the embodiment of FIGS. 1–6, the wire feeler is a coil spring 23 (FIGS. 5–6) having one end attached to the body 17 by fitting over a projecting body pin 24. The other end of the coil spring is bent to provide the transverse wire portion 22. The wire feeler is of a predetermined cross-sectional dimension to provide reliable reaction of the transverse wire portion 22 with serrated and nonserrated coin edges. The coil spring 23 resiliently mounts the wire portion 22 and flexes to reduce stress from coin impact.

A rail 25 provided adjacent to the support plate 11 is located in spaced relation from the wire feeler 21. This spaced relation is such that a coin traveling down the rail 25 leaves the rail in a predetermined trajectory directing it into engagement with the wire feeler 21. In other words, the transverse wire portion 22 of the wire feeler 21 intercepts the envelope of trajectory of the coin, the envelope being defined by the diameter of the coin, and engages the coin edge, as is shown best in FIGS. 1 and 3.

FIG. 2 indicates the path of the nonserrated coin 26 after engagement with the wire feeler 21. Because the coin 26 has a substantially smooth edge, the engagement by the coin 26 with the transverse wire portion 22 results in the feeler 21 moving upwardly under the impact of the coin 26 and carrying the body 17 with it. The body 17 swings about the seating of the shoulder 20 on the abutment 14, and the cooperation between the slot 19 and the pin 16 received therein acts to guide and limit the upward swinging movement.

The body 17 has a relatively small mass and in consequence, the coin 26 continues on a forward as well as a downward path. A kicker 27 is disposed in spaced relation below the wire feeler 21 downward of the nonserrated coin path. When the coin 26 impinges on the kicker face 30, the coin 26 is directed into a changed, predetermined path or direction. The momentum remaining in the coin 26 carries it to one side (the left side of FIG. 2) of a second kicker 31, whence it is carried into a rejection channel for return to the vending machine customer.

FIGS. 3 and 4 are comparable to FIGS. 1 and 2, except that the operation of the coin serration detector is considered in conjunction with a serrated coin 32. FIG. 3 is identical with FIG. 1, except that the transverse wire portion 22 is on the point of engagement with the serrations of the serrated coin 32. At this point, the wire feeler 21 is in precisely the same position as for a nonserrated coin 26 in FIG. 1. That is to say, the wire portion 22 of the wire feeler 21 lies within the trajectory envelope of the coin 32.

FIG. 4 illustrates the disposition of the serration detector following feeler engagement with the serrated coin 32. The wire feeler 21 is shown in dotted outline in FIG. 4 to indicate the original position in FIG. 3. The momentum of the serrated coin 32, after engagement by the transverse wire portion 22, rotates the wire feeler 21 and body 17 about the pin 16, thereby directing the coin 32 into a path or direction which is substantially vertical, at which time the coin 32 becomes disengaged from the transverse wire portion 22. The second abutment 15 of the stop means 13 is disposed in spaced relation from the pin 16, whereby to limit rotation of the body 17 about the pin 16. The abutment 15 is engaged by the shoulder 33 of the body 17 at the desired rotational limit to prevent the serration detector from rotating too far.

The disposition of the kicker 27 is sufficiently horizontally spaced from the downward path of the coin 32 to avoid contact with the coin 32. The second kicker 31 is disposed in spaced relation below the wire feeler 21 and is spaced to one side of the substantially vertical path of the coin 32. When the coin 32 contacts the kicker 31, the coin 32 is deflected to one side of the kicker 31 (the right side in FIG. 4), thereby directing the coin 32 to trigger the vending mechanism.

A modified form of the wire feeler 21 is illustrated in FIGS. 7 and 8. In this embodiment, the wire feeler 21 is substantially U-shaped having its ends 34 attached to the body 17 and having its bight providing the transverse wire portion 35 engageable with the coin edge. As in the embodiment of FIGS. 1–6, the wire feeler 21 of the embodiment of FIGS. 7–8 is of a predetermined cross-sectional dimension to provide reliable reaction of the transverse wire portion 35 with the serrated and nonserrated coin edges. The transverse wire portion has a predetermined radius that is consistent, and because the side of the transverse wire portion 35 is engageable with the coin edge, reliable and consistent results are obtained.

It is thought that the functional advantages of this coin serration detector have become fully apparent from the foregoing description of parts, but for completeness of disclosure, the operation of the device will be briefly described.

It will be assumed that the vending machine is intended to accept coins of a particular denomination which have serrated edges, and reject slugs or coins of substantially the same size and weight as the authentic coin, but without serrated edges. A slug 26, which has passed the weight and size test controlled by the cradle (not shown) will roll down the rail 25 and follow a predetermined trajectory which will load it into direct contact with the side of the transverse wire portion 22 of the wire feeler 21 of the serration detector. Because such a slug has a smooth edge, the wire feeler 21 is simply pushed upwardly, pivoting about the seating of the shoulder 20 on the abutment 14. The slot 19 receiving the pin 16 permits and guides this upward movement.

The slug 26 has retained sufficient forward momentum after engagement with the wire feeler 21 to carry it into contact with the face 30 of the first kicker 27. It strikes kicker 27 and rebounds into a new path which ultimately brings it into contact with the second kicker 31 and is directed to the left of such kicker 31 and hence to a rejection path leading to a coin return (not shown).

The path of the authentic coin 32, up until the time it engages the wire feeler 21, is substantially the same as that of the slug 26. However, as clearly shown in FIGS. 3 and 4, the side of the transverse wire portion 22 of wire feeler 21, on engagement with the serrated edge of the coin 32, causes the serration detector to rotate about the pin 16 in a counterclockwise direction. This rotation moves the wire feeler 21 downwardly toward the trajectory, rather than away from it, and substantially divests the serrated coin 32 of forward motion, and directs the coin 32 into a substantially downward path to contact the second kicker 31 and be directed to the right side of the second kicker 31. The serrated coin 32 is thence directed to appropriate mechanism that results in the triggering of the vending machine.

I claim as my invention:

1. A serration detector in a selector assembly for serrated and nonserrated coins in a coin acceptor and located downstream of a rail on a support which directs a coin in a predetermined trajectory, the serration detector comprising:

(a) a pivotally mounted body, and (b) a wire feeler attached to the body and providing a wire portion disposed transverse to and engaging the edge of a coin moving in the predetermined trajectory, the wire portion engaging the serrations of a serrated coin to rotate the wire feeler in one direction to change the trajectory and direct the serrated coin into one path, and engaging a substantially nonserrated coin to rotate the wire feeler in the opposite direction and permit movement of the nonserrated coin into another path.

2. A serration detector as defined in claim 1, in which:

(c) the wire portion engageable transversely with the coin edge has a predetermined cross sectional dimension to provide reliable reaction with the serrated and nonserrated coin edges.

3. A serration detector as defined in claim 1, in which:

(c) the wire feeler resiliently mounts the transverse wire portion engageable with the coin edge, and flexes to reduce stress from coin impact.

4. A serration detector as defined in claim 1, in which:

(c) the wire feeler extends from and positions the wire portion engageable transversely with the coin edge outwardly from the pivotally mounted body, the wire feeler being resiliently flexible.

5. A serration detector as defined in claim 1, in which:

(c) the wire feeler including the wire portion engageable transversely with the coin edge has a predetermined radius to provide reliable reaction with serrated and nonserrated coin edges.

6. A serration detector as defined in claim 1, in which:

(c) the wire feeler is substantially U-shaped having its ends attached to the body and having its bight providing the transverse wire portion engageable with the coin edges, the wire feeler being of a predetermined cross sectional dimension to provide reliable reaction of the transverse wire portion with the serrated and nonserrated coin edges.

7. A serration detector as defined in claim 1, in which:

(c) the wire feeler is a coil spring having one end attached to the body and having the other end providing the transverse wire portion engageable with the coin edges, the wire feeler being of a predetermined cross sectional dimension to provide reliable reaction of the transverse wire portion with the serrated and nonserrated coin edges.

* * * * *